US005304333A

United States Patent [19]

Trevino-Gonzales

[11] Patent Number: 5,304,333

[45] Date of Patent: Apr. 19, 1994

[54] CONCRETE PRODUCT MOLDING AND CURING PLANT METHODS AND APPARATUS

[76] Inventor: Francisco Trevino-Gonzales, 5a Ave. 609 Cumbres, 1er Sector, Monterrey N.L., Mexico, 64610

[21] Appl. No.: 966,003

[22] Filed: Oct. 23, 1992

[51] Int. Cl.[5] ..... B28B 11/00; F26B 3/00; F26B 19/00; F26B 25/06

[52] U.S. Cl. ..... 264/234; 34/38; 34/202; 34/217; 249/117; 264/297.9; 264/333; 264/345; 264/DIG. 43; 425/253; 425/404; 425/445; 425/452; 425/DIG. 117; 425/DIG. 118; 425/DIG. 202

[58] Field of Search ..... 264/333, 234, 345, 297.9, 264/DIG. 43, 86, 87, 138; 425/452, 253–255, DIG. 202, DIG. 117, DIG. 118, 404, 445, 446; 34/38, 202, 217; 249/134, 117

[56] References Cited

U.S. PATENT DOCUMENTS

| | | | |
|---|---|---|---|
| Re. 24,527 | 8/1958 | Ripley . | |
| 1,275,983 | 8/1918 | Rasmussen | 425/DIG. 117 X |
| 1,348,775 | 8/1920 | Bellonby | 264/82 |
| 1,427,825 | 9/1922 | Klein | 425/452 X |
| 1,899,137 | 2/1933 | Crume | 264/256 X |
| 2,152,365 | 3/1939 | Smith | 264/DIG. 43 X |
| 2,218,935 | 10/1940 | Ingersoll | 34/35 |
| 2,575,462 | 2/1949 | Nugey . | |
| 2,990,069 | 6/1961 | Repasky et al. | 425/452 X |
| 3,427,009 | 2/1969 | Shute . | |
| 3,739,050 | 6/1973 | Koncz et al. | 264/297.9 X |
| 3,957,937 | 5/1976 | Lovell | 264/82 |
| 4,099,337 | 7/1978 | Wauhop, Jr. | 264/82 X |
| 4,337,033 | 6/1982 | Drain . | |
| 4,629,417 | 12/1986 | Patalon | 34/38 X |
| 5,096,648 | 3/1992 | Johnson et al. | 264/334 X |

FOREIGN PATENT DOCUMENTS

| | | | |
|---|---|---|---|
| 2312092 | 9/1974 | Fed. Rep. of Germany | 264/345 |
| 2528901 | 12/1976 | Fed. Rep. of Germany | 34/518 |
| 612918 | 6/1978 | U.S.S.R. | 264/DIG. 43 |

*Primary Examiner*—Karen Aftergut
*Attorney, Agent, or Firm*—Laurence R. Brown

[57] ABSTRACT

Green concrete products, such as building products, are placed on pallets. Those pallets are transported to a kiln for curing and from the kiln after cure by an overhead crane. Pallets are lowered into and removed from open top kilns layer by layer being supported by movable support ledges, for example rotatable toggles, at each layer position which permit vertical entry and removal of the pallet layers. Three kiln compartments permit continuous production, one being filled, one being emptied and the third curing a load of pallet layers.

19 Claims, 3 Drawing Sheets

CONCRETE PRODUCT MOLDING AND CURING PLANT METHODS AND APPARATUS

TECHNICAL FIELD

This invention relates to plants for curing concrete products such as building blocks and more specifically it relates to apparatus and methods for efficiently processing concrete products at low equipment and labor costs in loading, unloading and curing cycles within specially constructed kilns.

BACKGROUND ART

The atmosphere inside a concrete curing kiln is hot and corrosive. Thus, the life span of moving, sliding and rubbing parts, such as shelves and carts used for conveying concrete products through a kiln is very short. Furthermore maintenance costs are high, and unscheduled down times are frequent because moving parts and pallets of concrete products being processed become jammed. This is a serious problem in a kiln where unscheduled stops require the kiln to be turned off, cooled down for maintenance and reheated after repair. Not only is this inefficient in loss of production time, but defective products or loss of the entire kiln contents occur because of critical concrete curing requirements within the kiln for preserving quality.

Concrete curing kilns are also very critical to curing conditions for producing strong, high quality concrete products without cracks, misshaping or broken products. In the building trades, very dry green concrete mixtures are fragile and must be gently processed to avoid spoilage. Accordingly there must be appropriate kiln construction for facilitating the critical handling necessary to produce high quality concrete products.

The manner of feeding green concrete products into the kiln and removing cured concrete products from the kiln is critical to the cost of the products in the very cost sensitive industry of the building trades which nevertheless demands high strength and quality products. Kiln design and curing system requirements in general require many different automated or manual transfers of blocks to and from different places and into different mechanisms resulting in high equipment and labor cost and high product losses due to breakage and mishandling. All of the known prior art concrete curing kiln constructions are considered to be awkward, inefficient, high cost and unsatisfactory in this respect.

Accordingly it is an object of this invention to provide improved, long life concrete curing kiln plants that gently convey the products, thus resolving the aforesaid problems.

Relevant prior art relating to concrete curing kiln plants includes a diversity of systems, typically operable by sending individual pallets of green concrete products serially through the kiln, stacking pallets in groups for conveyance into and out of the kilns, or filling wheeled carriages with pallets and wheeling the carriages through the kiln. All known systems have serious deficiencies for efficient mass production of concrete products in a continuously operated kiln. Typical patented concrete curing kiln art is now briefly surveyed.

A. L. Nugey, U.S. Pat. No. 2,575,462, Nov. 20, 1951, for Apparatus for Curing Building Blocks provides a long tunnel-like kiln through which a movable conveyor carries pallets. As aforesaid, the problems of long life and maintenance related to movable conveyor lines and their parts make this type of system non-competitive in the present status of the industry.

H. N. Shute, U.S. Pat. No. 3,427,0099, Feb. 11, 1969 for Apparatus and Method for Handling Concrete Blocks provides a crane assembly for lifting racks loaded with pallets in and out of a position in a kiln. The use of the racks introduces significant cost and production delays because of the labor and equipment required to handle pallets several times while filling and unloading racks outside the kiln and moving the racks in and out of the kiln. Also the deterioration of racks in the kiln and the necessity to use short life removable blankets to prevent escape of energy from an open top kiln imposes critical conditions and high maintenance costs.

B. R. Drain, U.S. Pat. No. 4,337,033, Jun. 29, 1982 for Apparatus for Curing Masonry Units is typical of serial feed kilns, where one pallet is serially inserted in a chosen one of multiple rows accessible in a continuously fired kiln. The pallets are inserted by sliding along rails to eject a pallet from the other end of the rails. Thus the rails are particularly susceptible to erosion, wear and breakdown. Accordingly, maintenance costs are high and breakdowns during production runs require shutdown of the entire kiln with interruptions in the critical curing process.

This type of kiln is even more expensive when rollered dollies are serially fed through because of the handling costs and inconveniences in loading dollies and the short working life of expensive wheeled dollies in the kiln atmosphere.

There is thus a significant motivation to provide improved concrete curing kiln systems that reduce product handling and maintenance costs and inconveniences and which are capable of increasing plant throughput capacity and life in the manner set forth in the following description.

DISCLOSURE OF THE INVENTION

Long life and simplified equipment maintenance, together with efficient, low cost product handling is achieved in the present invention along with a better quality product. Thus, handling damage to critical green molded concrete building blocks is reduced by novel methods provided here to avoid handling of the blocks between molding and stacking of cured blocks. Newly molded concrete products such as building blocks are thus automatically palleted by a molding machine, and the blocks are never removed from the pallets throughout the curing process. The pallets are carried by conveyor equipment to a waiting line of end to end pallets outside the kiln. Thereafter the pallets are processed through the kiln and loaded on an output conveyor without manual loading or unloading or relocation of the blocks from their initial position on the pallets.

Groups of end to end pallets loaded with freshly molded green concrete blocks are carried by an overhead crane and lowered into an open top kiln for stacking layer by layer from bottom to top in vertically spaced layers for curing after the kiln is covered. Then pallets carrying the cured blocks still in place are lifted one by one from the top of kiln stacks with the crane and placed on an output conveyor.

This is done without carriages or racks or any movement of pallets or block being required within the kiln during curing, thereby eliminating problems from jamming, wear and friction and reducing the cost of carrying racks or carriages that move through the kiln. Continuous production flow is maintained by means of disposing for servicing by the crane at least one group of three separate open top kiln compartments having replaceable lids. Then the three kiln compartments are sequenced between curing and loading and unloading cycles, thus achieving a steady and continuous production at high throughput capacity and kiln efficiency.

Lines of end to end pallets are lowered layer by layer with the crane into registered layered positions in specially constructed kiln compartments. Thus, rotatable toggle members in each layer from bottom upward are moved into place to support incoming pallet layers when they arrive. Similarly the toggle support members are moved out of the way layer by layer as the lines of pallets are raised from the top downwardly by the crane. Thus the toggles comprise rotatable shelf support sections positioned along the length of a pallet on either side to space the layers of pallets for cure. The toggles may be rotated manually from appropriately detented levers extending through the kiln walls.

For transit, the transport crane clamps the pallets on opposite sides and the line of pallets together end to end while on the input conveyor or at an uppermost cured layer of a kiln compartment and unclamps the pallets when carried to a resident rest position in a kiln layer or on the output conveyor. To avoid interference during loading and unloading of the kiln compartments, sectional spaced clamps centered on the pallet sides are interleaved in registry with the toggle shelf support sections inserted under the pallets at the end to end joints. Removable top lids for completely closing the kiln compartments are moved by the crane to a loaded kiln compartment ready for a cure cycle.

The conveyance system thus provides the advantage of moving and curing fragile cement building blocks without repositioning from the initial pallet position upon which the green products are molded, thereby materially reducing breakage and waste and significantly reducing plant and labor costs.

Also, a novel, low cost and long life kiln processes block without removing from its initial location on a pallet to eliminate costly repositioning steps, special racks or carriages for movement through the kiln, frictional and moving surfaces in the kiln during the curing cycle, and movement of individual pallets into and out of the kiln. Thus maintenance cost for reconditioning or emergency shutdowns is substantially reduced as well as lost batches of products in the kilns caused by shutdown at critical times in the curing process.

Further objects, features and advantages of the invention will be found throughout the following description, accompanying drawings and claims.

BRIEF DESCRIPTION OF THE DRAWINGS

Like reference characters are used to indicate similar features to facilitate comparison of the several views of the drawing, wherein.

THE PREFERRED EMBODIMENTS

Figure 1:
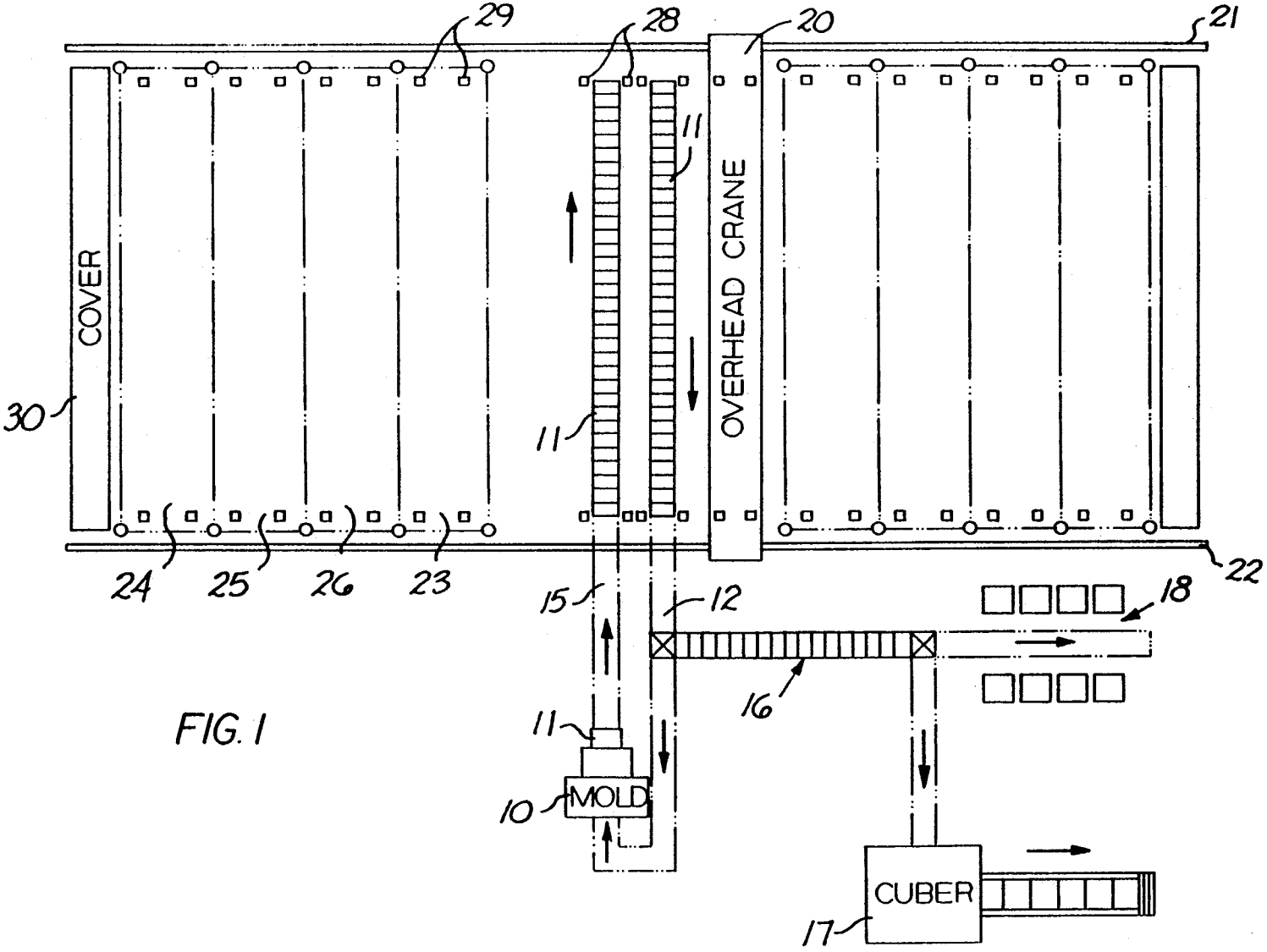
FIG. 1 is a top diagrammatic layout view of a concrete plant embodiment of the invention.

The concrete processing plant preferred layout embodiment of this invention is shown in the top view diagrammatic flow sketch of FIG. 1. Concrete products are molded at the automatic molding machine 10 which positions green molded concrete products, such as building blocks upon pallets 11 moved in place from the output conveyor line 12 and lined up in end to end position on the input conveyor line 15. Cured products are bypassed at 16 for processing at the cubing machine 17 or for storage at a plant site 18. The emptied pallets are returned to conveyor 12 for entry at the molding machine 10.

The overhead crane 20 movable along tracks 21, 22 has a movable cage, later described, that can pick up sets of end to end pallets loaded with uncured products from input conveyor line 11 and move them horizontally into position over one of the open top kiln compartments 23, 24, 25, 26, etc. for lowering into the kiln in separated layers from the bottom of the kiln upward.

Since green building block is a dry mix, it is very fragile and must be handled gently to avoid damage. This in part is achieved by means of mating guide rod sets 27, 28, 29 respectively in the crane, the conveyor lines, and the kiln compartments, which registers the crane to avoid any unscheduled impacts and stabilizes vertical movement in and out of the kiln, where dimensional tolerances are tight.

At least three kiln compartments are provided to provide for continuous curing in at least one compartment. A fourth will ensure that preventative maintenance can be done without shutdown, and may increase output production capacity depending upon the curing time cycles of the products, or alternatively provide for special processing of lower volume product lines. Also the right and left banks of kiln compartments can be serviced by the same overhead crane 20 for doubling plant production without doubling plant cost or labor cost. Cover tops 30 are also moved by the crane 20 to close the open top crane compartments when loaded and ready for cure.

Novel and advantageous features of this plant layout and product flow system include the features of: (1) the product molded on the pallets 11 is not moved off that pallet until cured and stored at an output station saving labor and equipment costs over those systems that require reloading of products into and out of carts or racks; (2) the inexpensive pallets are the only container for the products throughout the manufacturing process, thereby keeping plant expendable equipment costs low; (3) the pallets are moved in sets of end to end pallets that may constitute an entire layer along the length of the kiln compartments for efficient use of the crane system, simplification of pallet positioning procedures, and fewer pallet handling steps that could introduce shock and damage, particularly in the green product phase for dry mix building block, (4) confined movement paths provided by guiding of the crane cage into place to prevent movement into kiln walls, etc., and (5) as hereinafter will be made more clear, internal kiln construction that is simple and includes retractable supporting shelf structure for individually loading and unloading the kiln compartments from the top and registering the pallets being cured into spaced vertical layers.

Figure 2:
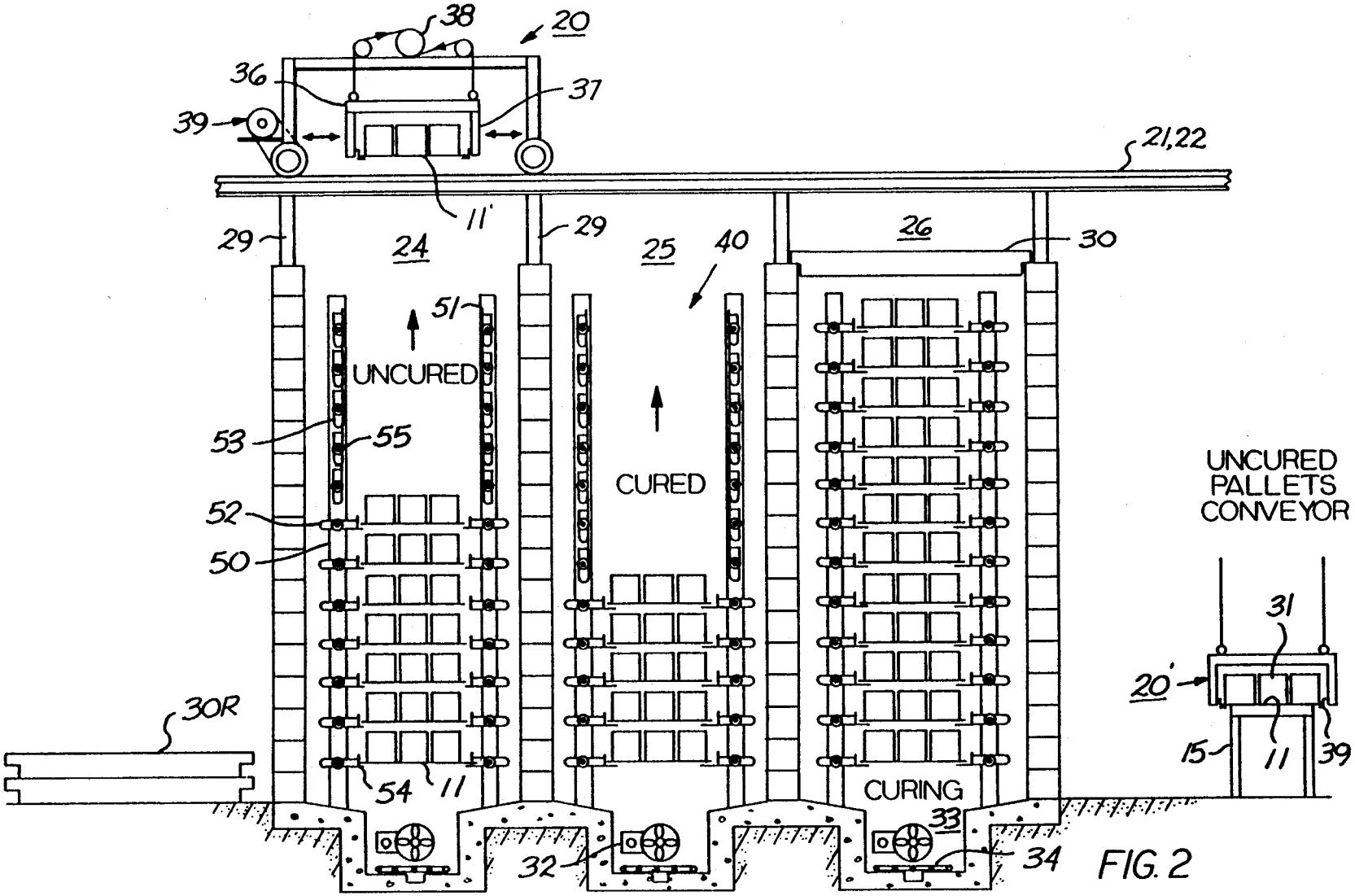
FIG. 2 is a side view diagrammatic sketch, partly in section of a kiln embodiment of the invention with accompanying pallet loading and unloading system.

The pertinent kiln and system apparatus subcombination shown partly in section in FIG. 2, shows respectively kiln compartment 24 being loaded with uncured green pallet sets, compartment 25 being unloaded after curing, and compartment 26 with cover 30 in place in the curing cycle, where fans 32 are controlled to circulate damp hot gas arising from the well 33 as controlled by heater tubing 34.

Overhead crane 20 as indicated by the double headed arrows moves back and forth on rails 22, and is registered at guide posts 29 for lowering a pallet set 11' grasped in cage 36 by means of pivotable clamps 37 on opposite sides of the pallets into partly filled kiln compartment 24. The carriage of overhead crane 20 is moved laterally by motor driven mechanism 39 and the cage 36 is lowered and raised by the motor driven mechanism 38. The uncured pallet set 11' loaded with uncured blocks 31 has been removed from the input conveyor line 15 where cage 20' is shown in its lowered clamping position with clamping brackets 39 pivotably moved into clamping positioned under pallet 11 for supporting it and raising it vertically from the conveyor line 15. The crane 20 in a similar manner clamps or hooks into loops (not shown) on the cover lids 30 to move them from storage rest position 30R to the top of the kiln (30) to cover the top access openings 40, as needed.

The downward loading of pallet sets 11' into the kiln compartment 24 is indicated by the downwardly pointing arrow, and the outward movement of cured products from kiln compartment 25 is indicated by the upwardly pointing arrow. The kiln compartments do not have to be fully cooled down for the loading and unloading cycles since all operations within the kiln are achieved by the mechanized crane system which may be manually or semi-automatically controlled. Thus, some heat is lost out of the open top, but that may be compatible with the initial part of the curing cycle where exothermic chemically generated heat in the products is preferably controlled. Thus, the overall curing cycle of this invention efficiently uses heat in the open top loading procedure.

In the kiln compartment 24, it is seen that the posts 50, 51 are spaced with a clear path for moving the pallets vertically within the kiln when the toggle supports 52 (FIGS. 4, 5) are rotated around shaft 55 into the non-interfering vertical position 53. Conversely, in the horizontal position toggle supports present the shelf segment support brackets 54 for extending under the pallets 11 on opposite sides to produce a retractable shelf mechanism. The toggle supports at each vertical layer are individually operated by means such as manual cranks 56 extending through the kiln chamber end walls and provided with a detenting mechanism 57 for holding the shaft 55 in the two stable vertically and horizontally disposed positions.

Thus, the loading procedure for the next pallet set 11' in the cage 36, is to rotate the toggle supports on both sides into the shelf support horizontal position to intercept and space the loaded pallet in the next higher layer. Then successive pallet sets are added until the kiln is filled and the top is moved from pile 30R to close the kiln for the start of a curing cycle.

A corresponding unload cycle alternately takes place in kiln compartment 25, so that the crane 20 is loaded in both directions, coming from conveyor 15 with a layer of green uncured products and returning to conveyor 12 (FIG. 1) with a layer of cured products.

Figure 3:
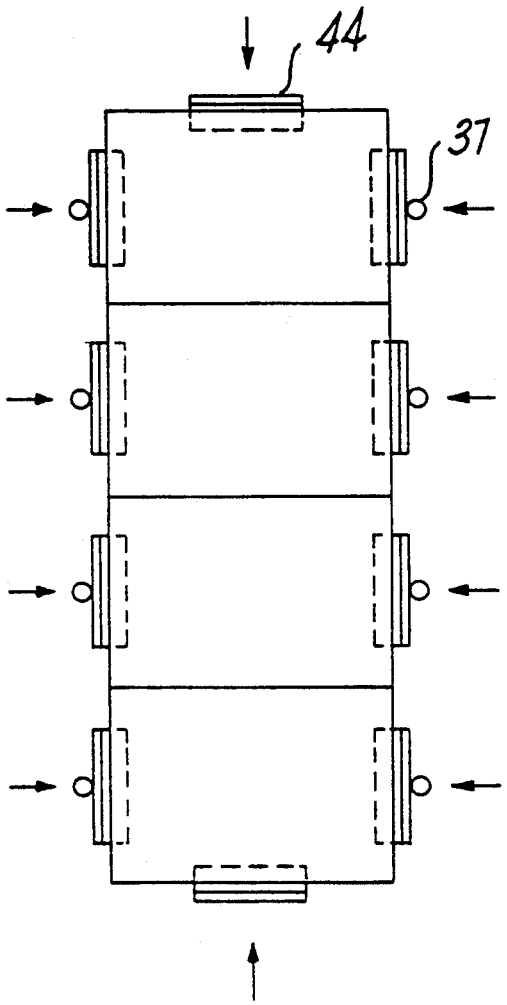
FIG. 3 is a fragmental top diagrammatic view of a conveyor pallet handling portion of the improved product handling system afforded by this invention.
Figure 4:
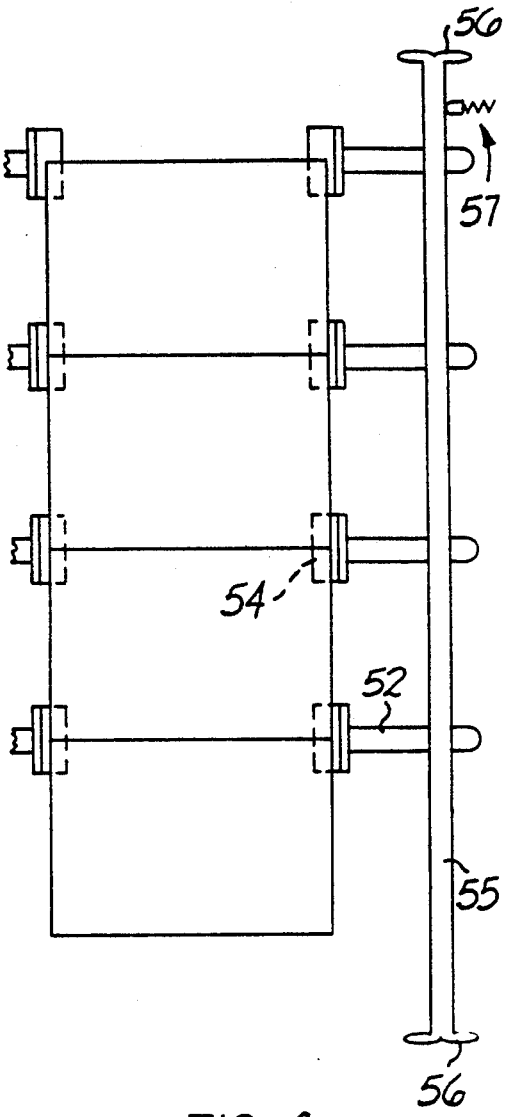
FIG. 4 is a diagrammatic top view, looking down at a resident pallet section of a fragmental portion of the kiln, placed in juxtaposition with intermediate pallet handling mechanisms of FIG. 3.
Figure 5:
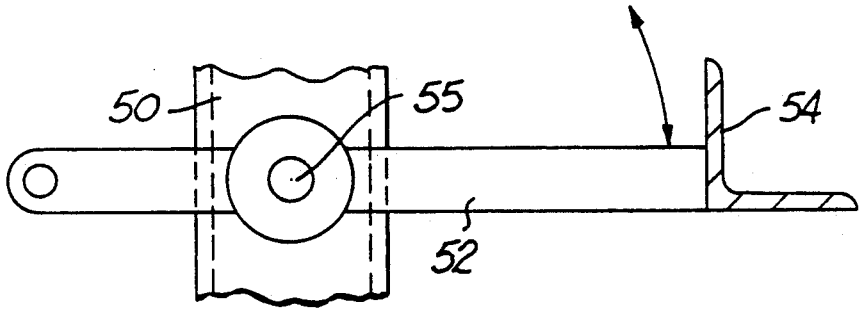
FIG. 5 is an enlarged fragmental view, partly in section of a novel mechanism portion for product racking within the kiln, a feature of the invention.

To avoid interference between the cage clamps 37 and the toggle shelf segments 54, the clamps and segments are respectively arranged in the staggered positions as shown in the top view sketch of FIGS. 3 and 4, wherein the set of end to end pallets is foreshortened to four for illustrative purposes.

The bilaterally clamping clamp sets 37 and 44 clamp the sets of pallets together in a stable horizontal configuration from both the sides of the individual pallets and the two end extremities of the pallet end to end array.

It is to be recognized by those skilled in the art that the dimensions of the kilns, the pallets and the sets of pallets may change for practical and engineering purposes, without departing from the spirit or scope of the invention for which the features of novelty are defined with particularity in the following claims.

I claim:

1. Apparatus for processing concrete products in a curing kiln, comprising in combination, a curing kiln, input means for positioning pallets containing green concrete products into single layered sets of pallets in end to end relationship, output means for receiving the sets of pallets from the kiln with the products having been cured, a set of kiln compartments with removable top cover plates for providing an access opening dimensioned for receiving and removing the sets of pallets arranged in end to end relationship vertically inside the kiln, pallet supporting means inside the kiln compartments for disposing the single layered pallet sets in spaced vertical layers during curing of the green concrete products without interfering with vertical positioning of pallets in the spaced vertical layers, and transport means for moving the sets of pallets into the kiln compartments into position on the pallet supporting means and out of the kiln compartments after curing of the green concrete products from the curing position on said pallet supporting means wherein the pallet supporting means further comprises a set of movable support segments for movement into and out of position for supporting the sets of pallets in the spaced vertical layers, and reciprocal positioning means for moving the support segments into and out of position respectively for supporting the sets of pallets and for moving the sets of pallets out of the kiln compartments.

2. The apparatus defined in claim 1, wherein the input means further comprises product molding means for forming green concrete products and positioning the green concrete products on pallets, and a conveyor for collecting the pallets in the end to end relationship.

3. The apparatus as defined in claim 1 wherein the reciprocal positioning means further comprises sets of rotatable toggle support segments disposed on opposite sides of the kiln compartments at respective spaced vertical layer positions, and rotating means extending outside the kiln for reciprocating the toggle support segments into and out of positions for supporting the pallets in the kiln compartments.

4. The apparatus defined in claim 1 wherein the transport means further comprises an overhead crane system with pickup means for clamping and holding together a plurality of pallets in the sets and conveying means for positioning the sets of pallets into the kiln compartments on the supporting means.

5. The apparatus defined in claim 4 wherein the pickup means further comprises means for bilaterally clamping the sets of pallets together in a stable horizontal configuration from two sides of individual pallets and two end extremities of the pallet sets in end to end relationship.

6. The apparatus defined in claim 1 wherein the transport means comprises an overhead crane with a load carrying cage elongated to span the sets of pallets in the end to end relationship.

7. The apparatus defined in claim 6 wherein the transport means further comprises guide means for registering the carrying cage with the sets of pallets to be picked up at the input means, and with the access opening of the kiln compartments.

8. The apparatus as defined in claim 1 wherein the set of kiln compartments comprises at least three fully closed side by side compartments when the top cover plates are in registry with the access openings, thereby to accommodate one compartment being heated for curing a batch of concrete products while a second compartment is being loaded with uncured concrete products and while the third compartment has cured concrete products being unloaded, thereby providing for a continuous curing process.

9. The apparatus as defined in claim 8 wherein four kiln compartments are provided so that a fourth compartment is being processed in a maintenance cycle without interruption to the continuous curing process.

10. The apparatus as defined in claim 9 wherein the pallet supporting means further comprises, displaceable shelving positionable within the kiln compartments movable into and out of position to support the pallets loaded with the green concrete products at the spaced vertical layers when pallets are lowered through the access opening.

11. The apparatus as defined in claim 10 wherein the displaceable shelving further comprises sets of rotatable toggle members for moving shelf sections from an inactive position within the kiln compartments permitting entry of the pallet sets into the access opening and downwardly past the toggle members into a horizontal position for forming shelves for supporting loaded pallets in the spaced vertical layers during a curing cycle.

12. A concrete curing kiln system comprising an open top kiln, displaceable shelving means at a set of spaced vertical positions within the kiln comprising a set of shelf sections and displacement means for respectively moving individual shelf sections of the set of shelf sections from a loading position vertically supporting individual sets of pallets loaded with concrete products to an entry position permitting entry of the individual sets of pallets into individual ones of the set of spaced vertical positions without impeded vertical positioning of the individual sets of pallets wherein the displacement means further comprises a set of movable support segments mounted on the kiln for movement into and out of the loading position for supporting the individual sets of pallets, and reciprocal positioning means for moving the support segments into and out of the loading positions respectively for supporting the individual sets of pallets and for moving the individual sets of pallets out of the kiln.

13. The method of curing concrete products in a kiln serviced by a product loading crane comprising the steps of:

placing a plurality of pallets containing green molded concrete products into single layered sets of pallets in end to end relationship, grasping with the loading crane individual single layered sets of pallets in end to end relationship and retaining the individual sets of pallets in the end to end relationship in a stable supported position with a mechanism of the crane, moving the individual sets of pallets with the crane, vertically moving the individual single layered sets of pallets into different individual ones of a plurality of vertical layer positions within the kiln for curing, and supporting the individual sets of pallets in the individual vertical layer positions within the kiln while curing the green molded concrete products on the pallets with movable pallet supporting means that respectively permit individual vertical positioning of the individual sets of pallets within the kiln and individual movement of the individual sets of pallets out of the kiln, which movable pallet supporting means comprise reciprocal positioning means for moving pallet supporting members into and out of position for respectively supporting the individual sets of pallets and permitting vertical positioning of the individual sets of pallets within the kiln for curing.

14. The method of claim 13 further comprising the steps of:

grasping the individual sets of pallets in the vertical layer positions within the kiln after curing and retaining them in the end to end relationship in a stable supported position with the crane grasping mechanism, moving the individual sets of pallets out of the kiln, and depositing the individual sets of pallets, at a cured product receiving location outside the kiln.

15. The method of claim 13 further comprising the steps of molding green concrete products, loading the green molded concrete products on pallets, and aligning a plurality of loaded pallets in end to end relationship in position for grasping by the crane grasping mechanism.

16. The method of claim 13 wherein the kiln has a replaceable lid for covering a top access opening for admitting and removing the pallets and the crane moves the crane grasping mechanism above the kiln access opening, further comprising the steps of:

lifting the pallet sets loaded with the green molded concrete products off a retaining surface in the grasping step, laterally moving the pallet sets for loading the kiln one by one into registry over the kiln access opening, loading the pallet sets in the kiln in a plurality of spaced vertical layers starting from a bottom layer, moving the supporting members into position to support the pallet sets at respective vertical layers, placing the replaceable lid over the kiln access opening, and curing the green molded concrete products in the kiln.

17. The method of claim 16 further comprising the steps of:

lifting the lid from the kiln following the curing of the green concrete products, removing the pallet sets layer by layer with the crane grasping mechanism from a top layer downward, and moving the individual removed pallet sets individually one by one to a cured product receiving station outside the kiln with the crane grasping mechanism.

18. The method of claim 13 wherein the grasping step further comprises the steps of compressing the pallet sets with crane grasping mechanism clamping means from sides of the pallets and at opposite ends of the end to end pallets in the sets.

19. The method of claim 13 further comprising the steps of:

movably mounting the pallet supporting members individually at respective individual vertical layer positions in the kiln respectively between the positions for permitting the individual sets of pallets to move vertically within the kiln and for supporting the pallet sets stably at the respective individual vertical layer positions.

* * * * *